United States Patent [19]

Briscoe

[11] Patent Number: 4,970,814

[45] Date of Patent: Nov. 20, 1990

[54] SYSTEM FOR EXCHANGING AND STORING WINDOW-DISPLAY POSTERS

[76] Inventor: David Briscoe, Donebacher Str. 2, 6933 Mudau, Fed. Rep. of Germany

[21] Appl. No.: 331,526

[22] PCT Filed: Sep. 21, 1987

[86] PCT No.: PCT/DE87/00425

§ 371 Date: Mar. 22, 1989

§ 102(e) Date: Mar. 22, 1989

[87] PCT Pub. No.: WO88/02532

PCT Pub. Date: Apr. 7, 1988

[30] Foreign Application Priority Data

| | | | |
|---|---|---|---|
| Sep. 23, 1986 | [DE] | Fed. Rep. of Germany | 3632291 |
| Feb. 13, 1987 | [DE] | Fed. Rep. of Germany | 3704483 |
| Feb. 18, 1987 | [DE] | Fed. Rep. of Germany | 3705107 |

[51] Int. Cl.[5] ..... G09F 11/30

[52] U.S. Cl. ..... 40/511; 40/476

[58] Field of Search ..... 40/511, 510, 509, 476, 40/370, 361-367, 159.2

[56] References Cited

U.S. PATENT DOCUMENTS

| | | | |
|---|---|---|---|
| 737,815 | 9/1903 | Bailey | 40/370 |
| 1,224,512 | 5/1917 | Teetor | 40/511 |

FOREIGN PATENT DOCUMENTS

| | | | |
|---|---|---|---|
| 500558 | 6/1930 | Fed. Rep. of Germany . | |
| 681722 | 9/1939 | Fed. Rep. of Germany | 40/476 |
| 698760 | 11/1940 | Fed. Rep. of Germany | 40/476 |
| 2615541 | 3/1978 | Fed. Rep. of Germany . | |
| 1055291 | 10/1953 | France . | |
| 1090604 | 10/1954 | France . | |
| 468947 | 8/1937 | United Kingdom . | |

*Primary Examiner*—Kenneth J. Dorner
*Assistant Examiner*—J. Hakomaki
*Attorney, Agent, or Firm*—Milde & Robinson

[57] ABSTRACT

A system for exchanging and storing window-display posters (1-6) has two storage areas (11,12) in which the posters are movably stored perpendicularly to their surfaces. Transport of the window-display posters between the storage zones is effected through two planes that border on the storage zones. At least one of the planes is arranged for displaying several posters. A conveyor is provided for carrying the posters into and out of the planes, as well as for guiding the posters within the planes.

26 Claims, 8 Drawing Sheets

FIG. 2A
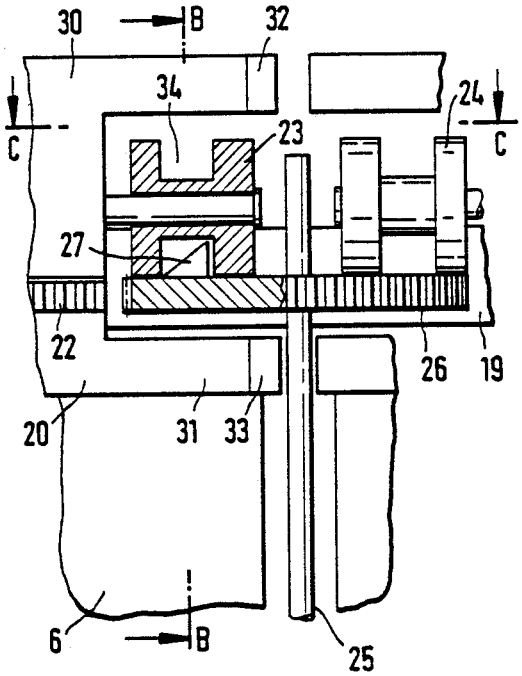
FIG. 2B
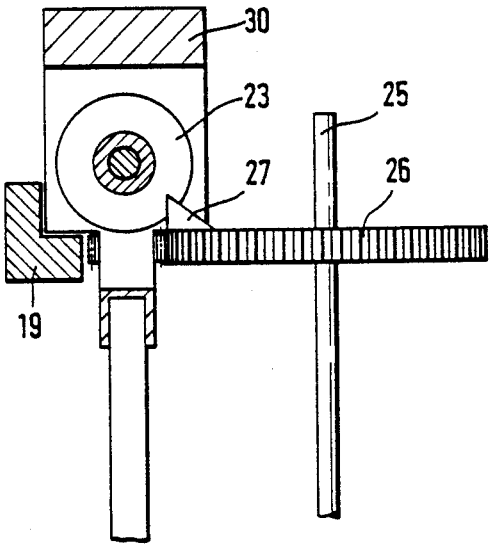
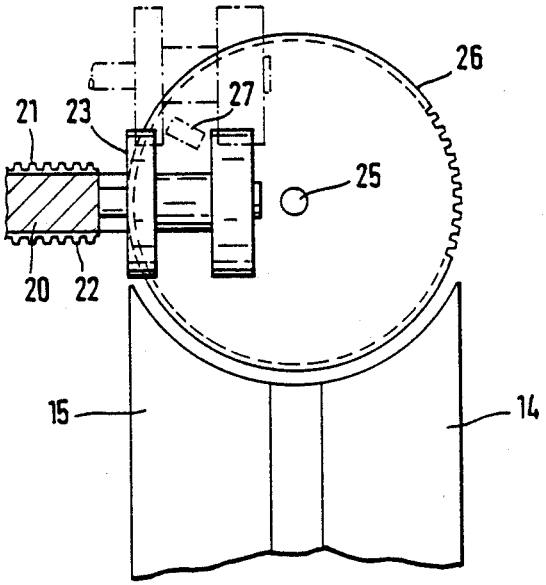
FIG. 2C

FIG. 5A
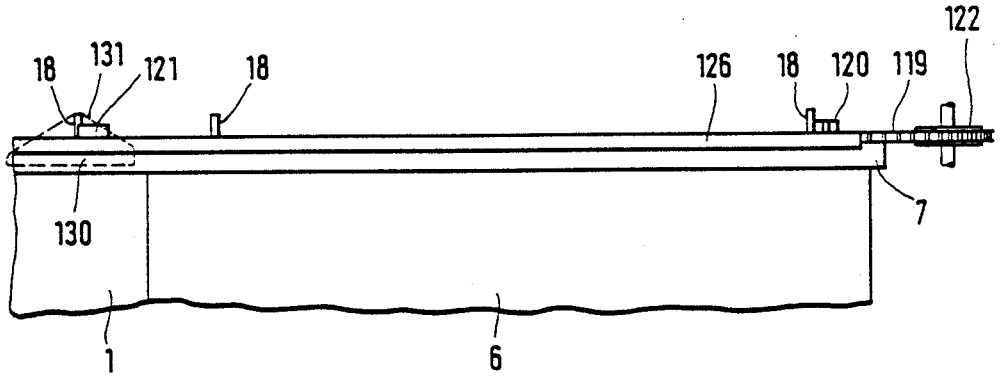
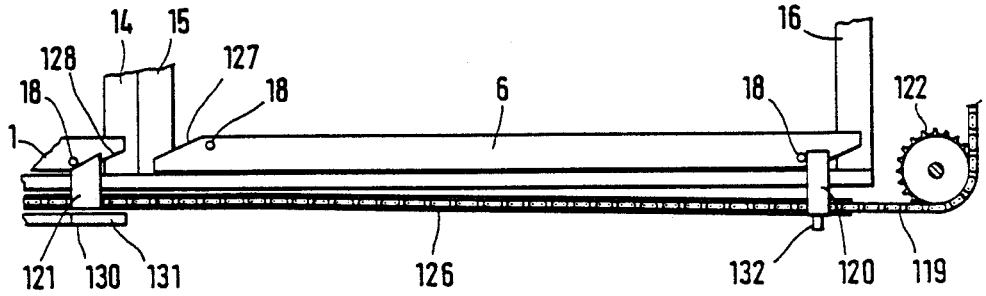
FIG. 5B

FIG. 6A
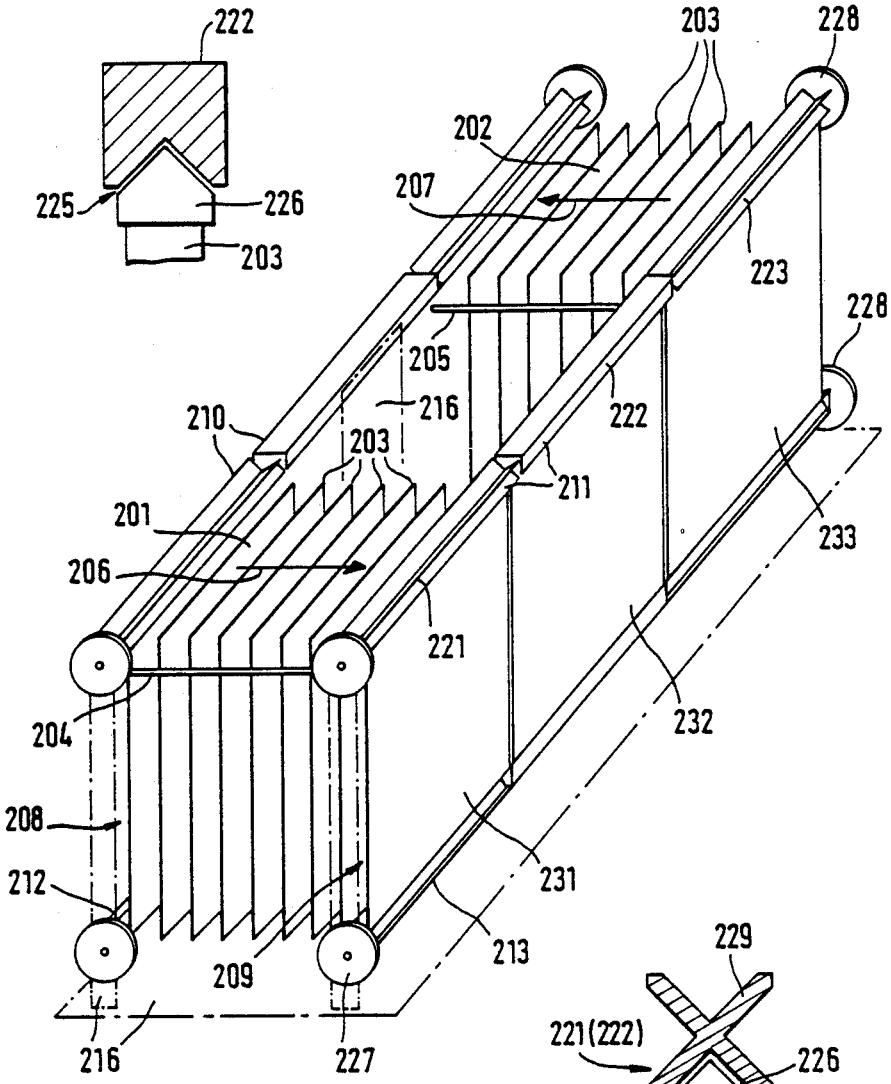
FIG. 6C
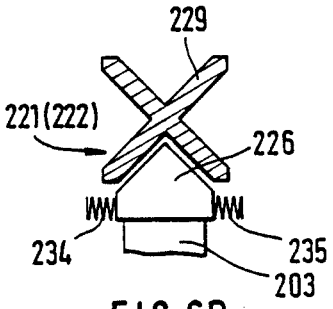
FIG. 6B

SYSTEM FOR EXCHANGING AND STORING WINDOW-DISPLAY POSTERS

TECHNICAL FIELD

The invention relates to a system according to the main claim.

Large window-display posters are frequently installed in conspicuous places, particularly for advertising purposes. In such cases, it is advantageous to change the information on the posters, both to attract more attention and to be able to display more information on a given area.

STATE OF THE ART

Various systems are already known, e.g. trom German Pat. No. 500 558 and 26 15 541 for transporting continuously exchangeable advertising means, such as e.g. glass show cases and windows. However, these systems are firstly very complicated and secondly are not suitable for storing a large number of display posters.

In addition, systems are known (GB-A-O 468 947, FR A-1 090 604, U.S.-A 2,016,748, FR-A-1 055 291), in which the display posters are transported from display planes into storage zones and vice versa. These systems are on the one hand very complicated and on the other only suitable for a given number of display posters. Thus, for example, in the system according to the British Patent, there are two storage zones and one display plane. By means of a revolving chain, one display poster is transported within the display plane from the left-hand to the right-hand storage zone and then on the back of the system a display poster is transported from the right-hand to the left-hand storage zone. This requires an uneven number of display posters , so that in each case one storage zone is completely filled, whereas one display poster is missing in the other storage zone. In addition, only the two front display posters located in the single display plane in the British Patent form a plane, so that it can only be used for a joint display with double format. The rear display posters in the storage zones according to the British Patent are located in two different planes, so that it is not possible to use the back as a display plane for two juxtaposed display posters.

DESCRIPTION OF THE INVENTION

The inventive system with the characterizing features of the main claim has the advantage compared therewith that, as a function of the detailed design, it is possible to store a varying number of window-display posters, without any need for complicated means for transporting the posters within the storage zones. It is a further advantage that in the inventive system two display posters are juxtaposed in the display planes, even if the storage zones are not completely filled with posters. The display posters can have different pictorial representations or displays, but are also suitable for displaying three-dimensional objects.

The measures given in the subclaims permit advantageous further developments and improvements to the invention given in the main claim.

In particular, according to a further development means are provided, which during the movement of in each case one window-display poster within the display plane, a further poster located in the display plane is moved into the storage zone. This makes it possible in a particularly simple way . . .

According to a further development for transporting the window-display posters into or out of the planes and for guiding them during movement within the planes, rotary rails with a cruciform cross-section are provided.

As a result of the measures given in the further subclaims, further advantageous developments and improvements to the invention are possible.

BRIEF DESCRIPTION OF THE DRAWINGS

The invention is described in greater detail hereinafter relative to non-limitative embodiments and the attached drawings, wherein show:

FIG. 2 a first system for transporting window-display posters within a display plane.

FIG. 5 part of the second embodiment on a larger scale and again in two views.

FIG. 6 a diagrammatic view of another embodiment.

The same parts are given the same reference numerals throughout the drawings.

Figure 1:
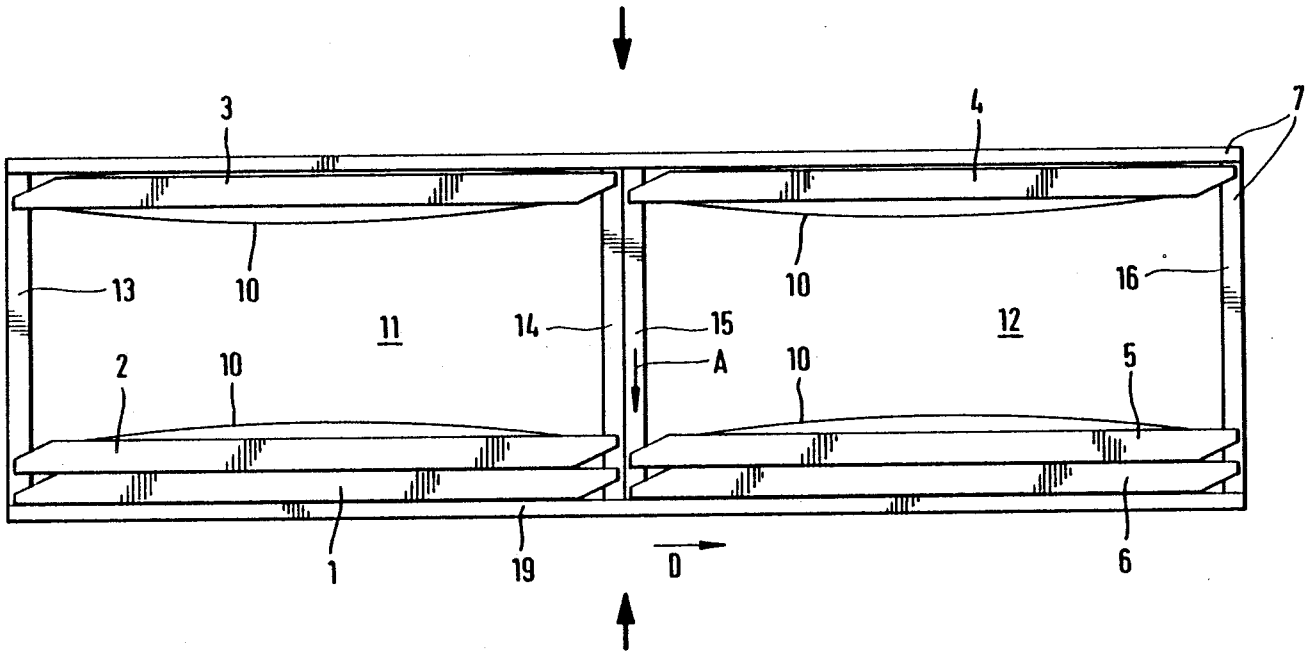
FIG. 1 a view of a first embodiment.

In the system according to FIG. 1 there are numerous window-display posters, whereof only six posters 1 to 6 are shown, being mounted in a frame 7. The window-display posters are in each case provided on their upper and lower edges 8,9 with leaf springs 10. If there is a sufficient number of display posters in the storage zone 11,12 the leaf springs are compressed. This on the one hand permits the transport of the display posters within the storage zones 11,12 and on the other hand on exchanging the display posters, one display poster can be inserted into the storage zone before on the other side a display poster has left said zone.

Placards can be stuck onto one or both sides of the window-display posters and preferably the placards stuck onto the two display posters in the display plane together provide a picture. As a function of the design of the individual display posters it is possible to observe the inventive system from one or both the directions indicated by the arrows. Rails 13,14,15,16 are provided for the movable storage of the window-display posters.

In the case of a first embodiment, the exchange of the window-display posters takes place with the system shown in FIG. 2, provided on the one hand at the top and on the other at the bottom in the center of the display planes of the system according to FIG. 1. FIG. 2*a* is a view in the direction of arrow A (FIG. 1), roller 23 and in part pinion 26 being sectioned. FIG. 2*b* is a cross-section at line B—B in FIG. 2*a*, but during a subsequent movement phase. The plan view of FIG. 2*c* essentially shows the pinion 26 and roller 23 in two movement phases.

Each of the window-display posters is provided at the upper edge with a ledge or strip 20, which on both sides carries a rack 21,22 and at each of the two ends a roller, whereof in FIG. 2 only roller 23 of display poster 6 and roller 24 of display poster 1 are shown. Within the storage zones, the rollers roll on rails 13 to 16 (FIG. 1), whereof rails 14,15 are shown in FIG. 2*c*.

Figure 3A:
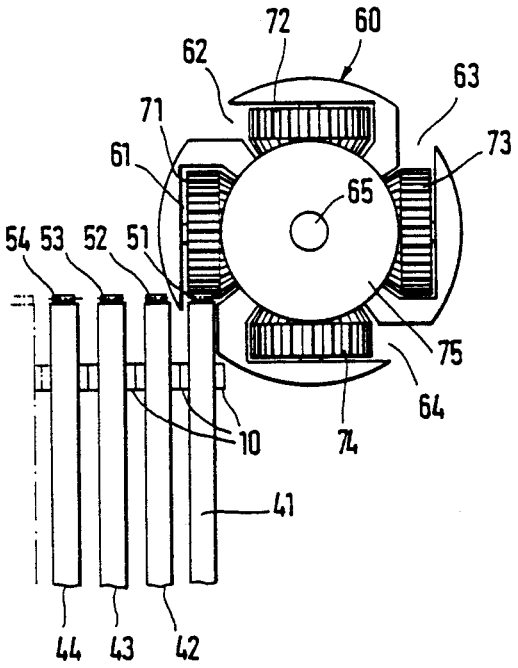
FIG. 3 a further system for transporting the window-display posters within the display plane.
Figure 3B:
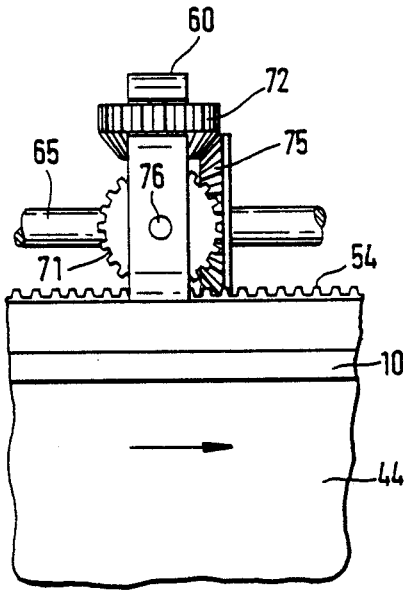

A pinion 26 driven by means of a shaft 25 is located in the same plane as rail 14,15. A further rail 19 forms a termination and guides the FIG. 3*a* shows a further system for transporting window-display posters within a display plane from the direction indicated by the arrow D in FIG. 1, FIG. 3*b* showing the same system from another side. The display posters 41,42,43 etc., are provided on their upper edge with in each case one rack 51,52,53 etc. A rotary disk 60 with four slots 61,62,63,64 is rotatably mounted about a shaft 65. The slots contain pinions 71,72,73,74 with in each case one radial tooth system and one conical tooth system, the latter engaging in a bevel gear 75 mounted on shaft 65. The mounting of pinions 71 to 74 takes place by means of pins inserted in corresponding bores of rotary disk 60, only one pin 76 being shown. Bevel gear 75 is located in non-rotating manner on shaft 65, so that it serves as a driving shaft for the bevel gear 75. Further details of the drive, particularly the intermittent drive of the rotary disk 60 are not shown in the drawing, because they can be realized with means already available to the Expert.

The window-display poster 41 located at the considered time in the display plane projects into slot 61 of rotary disk 60, so that rack 51 engages with pinion 71. Through the rotation of pinion 71 via bevel gear 75 and shaft 65 the window-display poster 51 is moved in the direction of the arrow. Once the display poster 41 leaves slot 61, display poster 42 is pressed by the tension of springs 10 in the direction of the display plane. However, display poster 42 can only enter the display plane when the slot 62 has reached the upper edge of display poster 42 and has received the latter. The rack 52 then engages with pinion 72, so that the window-display poster 42 is moved in the direction of the arrow, this process being continuously repeated.

Figure 4A:
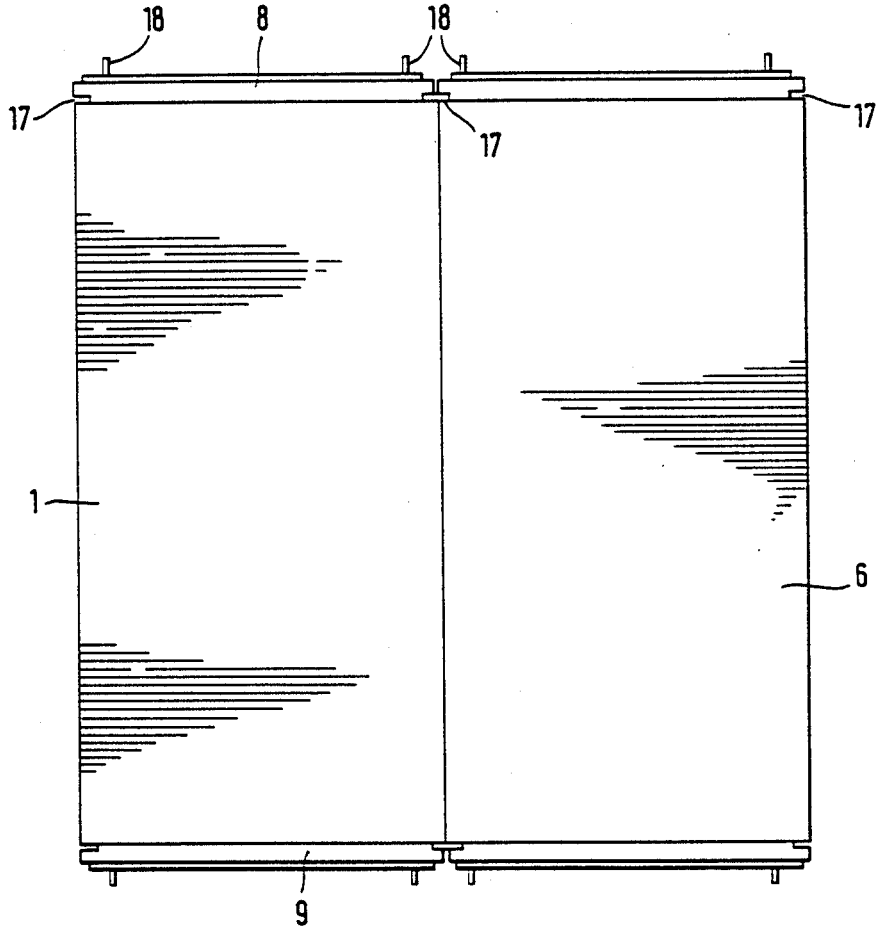
FIG. 4 a view and a plan view of a second embodiment.
Figure 4B:
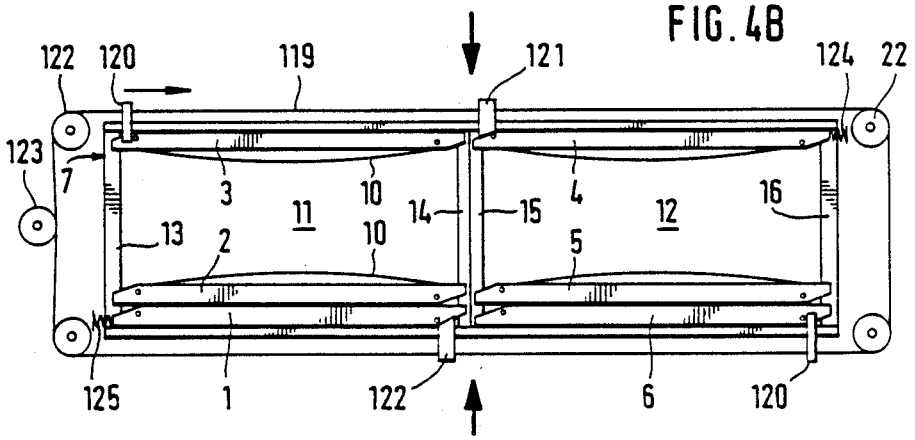

The system according to FIG. 4 is extended compared with that of FIG. 1 in that in each case on one side of the display plane springs 124, 125 are provided, which compress the plates in the display planes.

For the movable mounting of the window-display posters rails 13,14,15, 16 are provided, which engage in the corresponding grooves 17 of the display posters. The display posters are provided on their upper and lower edges with in each case two pins 18, which are used for transporting the display posters. On a chain 119 revolving in the direction of the arrow are provided displacing and driving elements 121,120, whose precise function will be explained in conjunction with FIG. 5. The revolving chain 119 is driven with the aid of a motor and a gear, which are not shown in the drawing, via one of the pinions 122. A chain tightener 123 is also provided.

FIG. 5 shows part of the system of FIG. 4 on a larger scale So that the displacing element 121 does not necessarily contact the pins 18 of window-display poster 6 and therefore press back the latter, a U-rail 126, which guides chain 119, is shaped in such a way that the spacing between chain and display poster 6 or its pins is larger than the greatest width of the displacing element 121. Only at pin 18 of display poster 1 is the spacing between chain 111 and the display poster sufficiently small to enable the displacing element 121 to press the display poster 1 into the storage zone 11 and therefore space is provided for the display poster 6 which has in the mean time been moved by driving element 120. The bevels 127,128 of the display posters bring about a further displacement or deflection of the display poster 1 which has only been partly displaced by displacing element 121. The display posters can also be constructed in such a way that there is no need for a displacement thereof by means of displacing elements 121.

If the window-display poster 6 moved by the driving element 120 has reached the left-hand position, then the driving element 120 is raised via pin 18 of display poster 6, so that the latter remains stationary and further movement is possible of chain 119 with driving element 120. For this purpose a part 130 is provided fixed with a bevel 131 and is encountered by an extension 132 of driving element 120, in such a way that element 120, including chain 119, is raised at this point. Part 130 is shown in broken line form, in order to make it possible to see the displacing element 121.

As the revolving chain 119 carries two driving elements 120 and two displacing elements 121, during a revolution in each case two window-display posters are transported, so that a new picture appears in the display planes following one revolution of chain 119.

In the case of a corresponding design of the system the driving element and displacing element can also be shaped in such a way that, as a function of the installation direction, a single component with a bevel can be used both as the driving element and as the displacing element.

In the system according to FIG. 6 and in the other embodiments, two storage zones 201,202 are provided, within which the window-display posters 203 are movably mounted in the direction of arrows 206,207 by suitable rails, whereof only rails 204,205 are diagrammatically shown in FIG. 6.

In each case three display posters can be located in one of the planes 208,209, where they together form a picture. It is a function of the use of the inventive system, where the merely one side of the display posters 203 is provided with corresponding displays or representations, so that in each case only one of the planes 209,208 is used as a display plane, or alternatively the display posters are provided on both sides with representations, so that the inventive system is observed from both sides.

For transporting the display posters from one of the storage zones into the display plane and vice versa, means 210,211,212,213 are provided, which are substantially the same. A description is merely given hereinafter of means 211 as a representative of the further means. The essential part of means 211 is a rail extending over the total length of the system according to FIG. 6 and which is formed from three partial rails 221,222,223. The central partial rail 222 is fixed to a frame 216 carrying the complete system according to FIG. 6 and has the profile shown in cross-section in FIG. 6*a*. A guide element 226 of a window-display poster 203 engages in the downwardly open groove 225.

The partial rails 221,223, which are adjacent to the storage zones about the longitudinal axis thereof by means of suitable driving mechanisms 227,228. A guide element 226 of a display poster 203 can be guided in the angles formed by the spokes 229 of the cruciform profile. On rotating the cruciform partial rail 221,223 by 90°, in each case one display poster 203 is removed trom the storage zone 201 and transported into storage zone 202.

Various means can be provided for moving the window-display posters along the rails, i.e. within the display plane. However, before going into detail in connection with these means, the function of the system according to FIG. 6 will be explained.

The starting position is taken as that in which the three window-display posters 231,232,233 are located in the display plane. For displaying a new picture firstly the display poster 233 is to be brought out of the display plane into the storage zone 202. For this purpose the cruciform partial rail 223 is rotated clockwise by 90°. In order to obtain a buffer action within the storage zones 201,202 making it possible to avoid the need for precise reciprocal matching of the movements through the rails in the vicinity of display plane 208 on the one hand and the rails in the vicinity of display plane 209 on the other, the display posters 203 are provided in one marginal area with spring elements 234,235 shown diagrammatically in FIG. 6*b*. Display poster 233 is moved into storage zone 202 through the aforementioned rotation of partial rail 223 and in opposition to the tension of said springs. Then, through the subsequently explained transporting means, the display posters 231,232 are moved within the display plane 209 in such a way that the display poster 232 reaches the position previously occupied by display poster 233 and display poster 231 reaches the central position.

As the next stage a further display poster 203 is brought out of the storage zone 201 into the display plane by rotating the partial rail 221 and a corresponding lower partial rail. Display poster 232 is then moved into the storage zone 202 by rotating partial rail 223. This process is repeated until posters 233,232,231 are in the storage zone 202 and the new posters are in the display plane 209. A corresponding number of posters 203 are brought simultaneously from the display plane 208 into storage zone 201 and from storage zone 202 into display plane 208.

Figure 7:
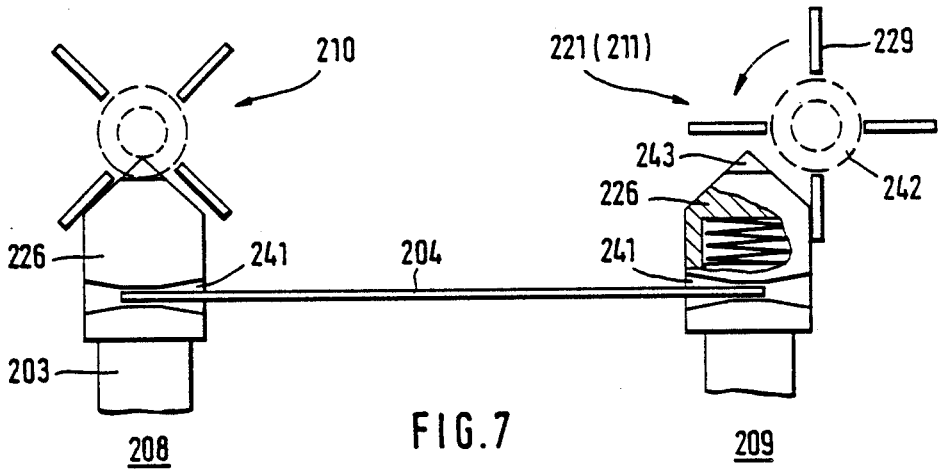
FIG. 7 a detail of the embodiment of FIG. 6.

FIG. 7 shows in somewhat greater detail a detail of the system according to FIG. 6, in which one rail 204 guides the display posters 203 located in one storage zone. The guide element 226 of display posters 203 have corresponding recesses 241 for this purpose. Of the window-display posters located in a storage zone only two are shown, namely that located in display plane 208 and whose guide elements 224 engage in rail 210, and a further poster brought by rotating the rotary partial rail 221 out of the storage zone and into the display plane 209. So that the guide element 226 can adapt to the angular position of the rotary partial rail 221, the part of the guide element 226 engaging in the rails is flexibly mounted, as is diagrammatically indicated in FIG. 7.

For moving the display posters 203 within the display planes 208,209 spindles are provided in the longitudinal axes of rails 210,211,212, 213 (FIG. 6) and are driven independently of the rotation of the rotary partial rails.

During the further rotation of the partial rail 221 shown in FIG. 7, the upper part of the guide element 226 having a tooth system 243 passes into the vicinity of spindle 242 and is consequently moved within the display plane 209. If the poster has reached its intended position, then either the drive of spindle 242 can be disconnected, or through a corresponding guidance of guide element 226 with a movement in opposition to the spring tension, the coupling between spindle 242 and tooth system 243 can be removed. Automatically uncoupling takes place, if a poster is brought from the display plane into a storage zone by a corresponding rotation of a rotary partial rail.

Figure 8:
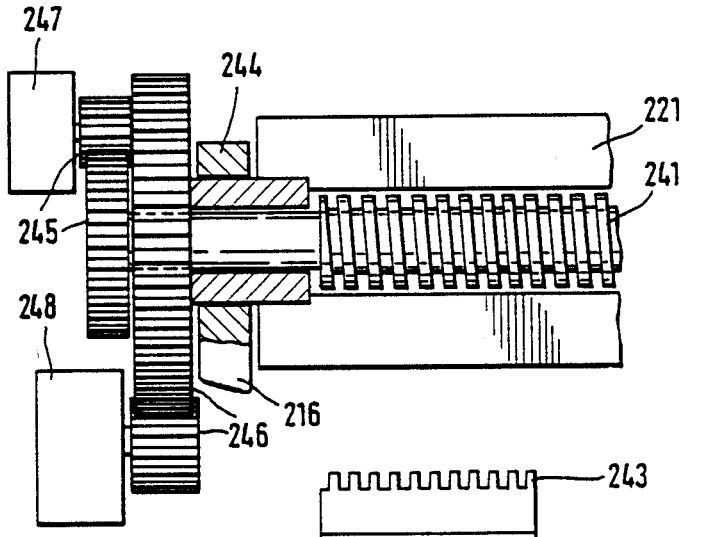
FIG. 8 a detail of a rail.
Figure 9:
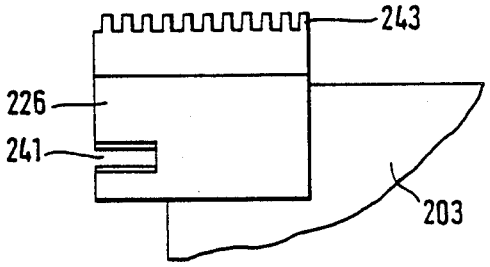
FIG. 9 a guide element for a window-display poster.

FIG. 8 shows part of the rotary rail 221 and spindle 242, whilst FIG. 9 shows a guide element 226, whose tooth system 243 is adapted to the thread of spindle 242. Spindle 242 and rotary rail 221 are mounted at 244. The not shown end of the rotary rail 221 is mounted in partial rail 222. A gear 245,246 and an electric motor 247,248 are shown in FIG. 8 as drive means for rail 221 on the one hand and spindle 242 on the other.

As a function of the particular requirements, it is also possible to make only those parts of partial rails 221,223 (FIG. 6) rotary, which face the guide elements 226 of the display posters in the storage zones. The intermediate parts of partial rails 221,223 can then be fixed in the same way as partial rail 222.

With the aid of FIG. 10, which shows a system otherwise corresponding to that of FIG. 6, a further example for a drive of the window-display posters within the display planes will be explained. Thus, there is a revolving element 251, e.g. a chain or a toothed belt, which is guided over two diagrammatically represented wheels 252,253, whereof one is driven with the aid of a motor 254 and a gear 255. To the revolving element 251 is fixed a driver, which abuts against the edge of the poster 203 in the vicinity of partial rail 221 and moves it to the right. When the display poster 203 has reached its intended position, the driver 256 is tilted out of the display plane by a suitable bevel 257 and can move a further poster during the next revolution of the revolving element. If no movement is required, then the drive means is disconnected.

Figure 10:
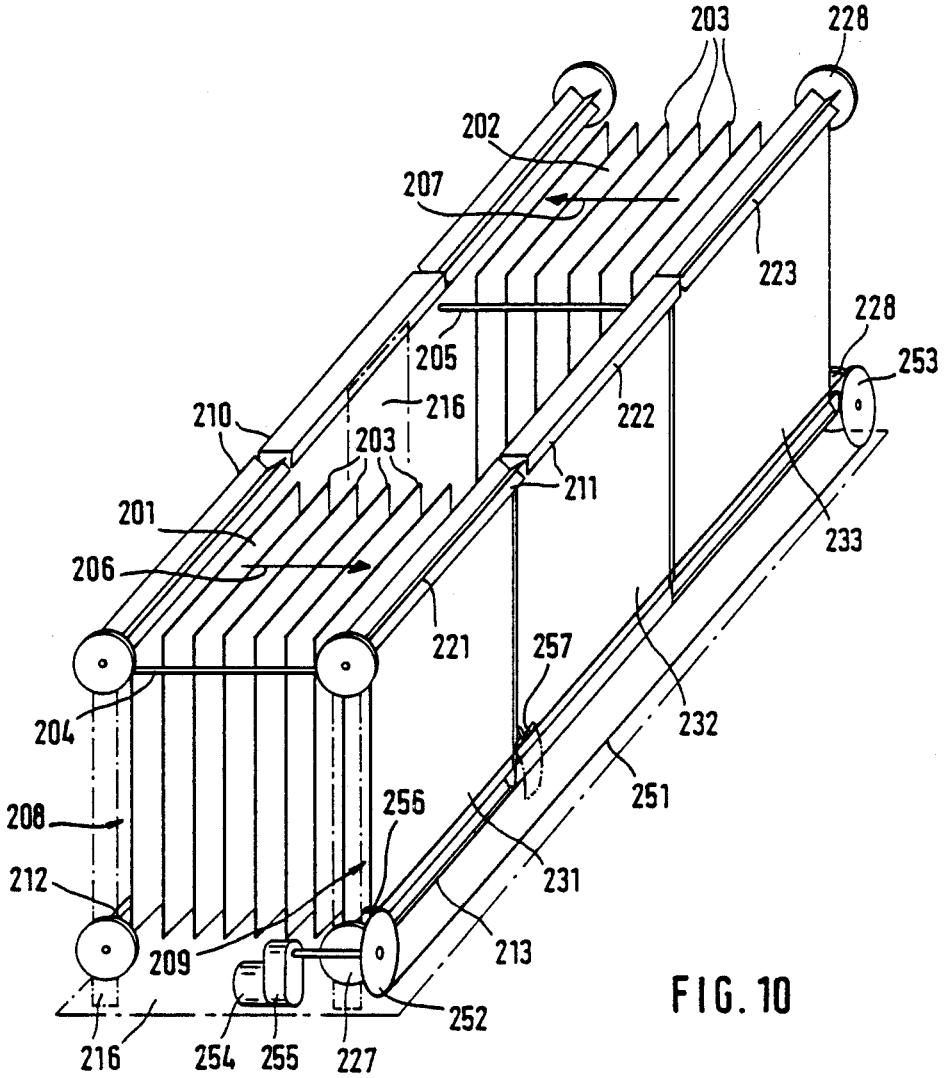
FIG. 10 another example for an inventive system in diagrammatic form.

Both the drive means with the aid of a spindle and the drive means explained in conjunction with FIG. 10 can be provided in the vicinity of one or both rails of the display planes 208,209, which depends on the requirements and the size relationships.

In the represented embodiments the window-display posters in the storage zones 201,202 are advanced by the posters introduced into said storage zones. However, this presupposes, that there is a certain minimum number of posters in the system. However, to adapt the system to a given number of posters, the length of the storage zones can be made variable and for this purpose rails 204,205 can e.g. be made telescopic.

The drawings show the inventive system in such a way that the display posters are moved horizontally in the display plane. However, the inventive system can also be set up on edge, so that the posters are moved vertically in the display plane.

I claim:

1. System for exchanging and storing window-display posters, wherein two storage zones (11, 12; 201, 201) are provided, in which the window-display posters (1 to 6; 41 to 44; 203) having substantially planar opposite surfaces are mounted in movable manner at right angles to their surfaces, wherein two planes (208,209) are adjacent to the storage zones (11, 12; 201, 202) in which transportation of the display posters (1 to 6; 41 to 44; 203) takes place between the storage zones (11, 12; 201, 202), at least one of the planes (208, 209) being provided for displaying several display posters (1 to 6; 41 to 44; 203) and wherein means are provided for transporting the display posters (1 to 6; 41 to 44; 203) into and out of planes (208, 209) and for guiding the display posters (1 to 6; 41 to 44; 203) during movement within the planes (208, 209), characterized in that the window-display posters (1 to 6; 41 to 44; 203) each comprise at lest one spring element (10; 34, 35) which acts at right angles to a surface of the respective display poster and, in the case of several display posters located in a storage zone (11, 12; 201, 202), brings about a reciprocal repulsion of the display posters.

2. System according to claim 1, characterized in that the spring elements are formed by leaf springs (10).

3. System according to claim 1, characterized in that for the transportation of the window-display posters (1 to 6; 41 to 44) on the latter are provided racks (21, 22; 51 to 54), which during transportation are in engagement with pinions (26; 71 to 74) when the posters pass from the storage zones into the planes.

4. System according to claim 3, characterized in that the means are formed by cams (27), which engage in recesses (34) of window-display posters (1 to 6).

5. System according to claim 4, characterized in that the cams (27) are provided on pinions (26), which are arranged at the end regions of rails (14,15), which guide the display posters (1 to 6) within the storage zones (11,12), that in each case one circular surface of the pinions (26) forms the extension of the surface of rails (14,15) and that the display posters (1 to 6) are movable on rails (14,15) by means of rollers (23).

6. System according to claim 5, characterized in that the rollers (23) in each case have an all-round groove (34), which serves as a recess for the cam.

7. System according to claim 5, characterized in that the cam (27) is adjustable in such a way that it only passes out of the pinion (26) for the given rotation angle.

8. System according to claim 3, characterized in that means for engaging said racks with said pinions are formed by rotary disks (60), whose shafts (65) are substantially parallel to the display plane, that the rotary disks (60) are in each case provided with at least one slot (61 to 64) emanating from the circumference and in which a pinion (71 to 74) is arranged in such a way that a rack (51 to 54) arranged on the display poster (41 to 44) engages with the pinions (71 to 74) on entering a slot (61 to 64).

9. System according to claim 8, characterized in that the rotary disk (60) is rotatable in an intermittent manner.

10. System according to claim 8, characterized in that the pinions (71 to 74) in slots (61 to 64) have in each case a conical tooth system as well as a radial tooth system and in same engages a bevel gear (75) mounted equiaxially with the rotary disk (60).

11. System according to claim 1, characterized in that means (121,127,128) are provided which, during the movement of in each case one display poster (1 to 6) within the display plane, move a further display poster (1 to 6) located in the display plane into the storage zone (11,12).

12. System according to claim 11, characterized in that the display posters (1 to 6) are bevelled on two facing edges in such a way that during the movement of one display poster (6) within the display plane a bevel (127) of said poster slides over the bevel (128) of the further poster (1) located in the display plane and the further poster (1) is moved into the storage zone (11).

13. System according to claim 12, characterized in that the display posters are provided with stops (18), in operative connection with displacing elements (121) and driving elements (120), which are arranged on a revolving chain (119), and that the two displacing elements (121) and two driving elements (120) are arranged in alternating manner on the revolving chain (119).

14. System according to claim 13, characterized in that the displacing elements (121) in each case have a bevel, which forms an acute angle with the longitudinal direction of the chain (119) and is directed in such a way that on reaching a stop (18) on the display poster, the displacing element (121) passes between chain (119) and stop (18).

15. System according to claim 13, characterized in that guide elements (126,130,131) are arranged in the vicinity of chain (119) in such a way that there is a coupling and uncoupling between the displacing and driving elements (120,121) and stops(18), that the guide elements are at least partly formed by guide rails (126), through which the chain (119) is guided at least partly in sloping manner to the display plane, and that further guide elements are formed by bevels (130,131), which raise the driving elements (120) over stops (18).

16. System according to claim 9, characterized in that on each window display poster (1 to 6) and in each case on one edge (8,9) are provided two stops, particularly pins, whereby the pins (18) are located in the vicinity of one of the visible surfaces of the display posters close to that corner which, on moving the posters, is directed opposite to the movement direction within the display plane.

17. System according to claim 16, characterized in that two stops, particularly pins (18) are provided on two facing edge (8,9) of each display poster.

18. System according to claim 1, characterized in that the means for transporting the display posters comprise rotary rails (221, 223) with a cruciform cross-section.

19. System according to claim 9, characterized in that the rotary rails (221,223), engage with two facing edges of the display posters (203) to be transported.

20. System according to claim 18, characterized in that on two facing edges of the display posters (203) are provided guide elements (226) with a substantially triangular cross-section.

21. System according to claim 19, characterized in that the guide elements (226) are resiliently constructed in the direction of the surface of the display posters (203).

22. System according to claim 18, characterized in that two display posters (203) are arranged in juxtaposed manner within one plane (208,209) and that the rotary rails (221,223) are subdivided into in each case two successively arranged and independently rotatable partial rails (221,223).

23. System according to claim 18, characterized in that in each case one of the planes (208,209) receive more than two display posters (203) and that the rails are in each case subdivided into several partial rails (221,222,223), the outer partial rails (221,223) being rotatable independently of one another and the central partial rail (222) does not rotate.

24. System according to claim 18, characterized in that spindles (242) are provided in the longitudinal axes of the rails (221,222,223) and in the same engage guide elements (226) of display posters (203) provided within corresponding tooth system (243).

25. System according to claim 18, characterized in that for moving the display posters (203) within planes (208,209), at least one driver (256) per plane is provided and is linearly movable.

26. System according to claim 1, characterized in that for the movable mounting of the display posters (1 to 6;203) in storage zones (11, 12; 201, 202) further rails are provided, which have a telescopic construction.

* * * * *